United States Patent [19]

Larsson et al.

[11] 4,413,464

[45] Nov. 8, 1983

[54] PROCESS OF PRODUCING A PACKAGE OR WRAPPING FOR STORING OR SHIPPING MATERIAL

[75] Inventors: Lars-Gorän Larsson, Malmö; Bertil S. O. Murne, Oxie, both of Sweden

[73] Assignee: Aktiebolaget Platmanufaktur, Malmö, Sweden

[21] Appl. No.: 835,050

[22] Filed: Sep. 21, 1977

Related U.S. Application Data

[62] Division of Ser. No. 681,231, Apr. 28, 1976, abandoned.

[51] Int. Cl.[3] ..... B65B 43/08; B65B 61/18

[52] U.S. Cl. ..... 53/412; 53/449; 53/456; 53/484

[58] Field of Search ..... 53/27, 29, 46, 175, 53/412, 449, 452, 482; 93/36.01; 220/404, 460, 462, 463; 229/58, 61

[56] References Cited

U.S. PATENT DOCUMENTS

| | | | |
|---|---|---|---|
| 1,766,405 | 6/1930 | Shaw | 53/46 X |
| 2,023,682 | 12/1935 | Higginbottom | 53/482 X |
| 2,048,122 | 7/1936 | Howard | 229/61 X |
| 2,072,421 | 3/1937 | Daller | 53/27 |
| 2,152,323 | 3/1939 | Moore | 53/482 X |
| 2,252,106 | 8/1941 | Waters | 53/27 |
| 2,309,760 | 2/1943 | First | 53/27 |
| 2,310,382 | 2/1943 | Allen | 53/46 X |
| 2,339,305 | 1/1944 | Wagner | 229/61 |
| 2,361,408 | 10/1944 | Moore | 53/482 X |
| 2,365,159 | 12/1944 | Walton et al. | 53/27 |
| 2,382,987 | 8/1945 | Gardner | 53/27 |
| 3,105,573 | 9/1964 | Piazze | 229/53 |
| 3,241,291 | 3/1966 | Monroe | 53/375 |
| 3,266,390 | 8/1966 | Carpenter, Jr. | 93/36.01 |
| 3,314,210 | 4/1967 | Jarund | 53/175 X |
| 3,435,736 | 4/1969 | Reiche | 229/58 |
| 3,944,127 | 3/1976 | Bruke et al. | 220/404 |

*Primary Examiner*—John Sipos

*Attorney, Agent, or Firm*—Hane, Roberts, Spiecens & Cohen

[57] ABSTRACT

A method of producing a package for storing and/or shipping material, and particularly pulverized material such as coffee, provides producing an inner container for placing therein the material by folding flexible sheet material so as to form a substantially rectangular shape and securing the folded edges to each other by adhesion. The so-obtained inner container is inserted into an outer container of similar shape and attached to the inner wall surface of the outer container. One side of the inner container can be conveniently cut open for removal of material and the outer container has on its side adjacent to the side of the inner container which is intended to be opened a closure member which can be opened to provide access to the inner container and can be closed again.

8 Claims, 12 Drawing Figures

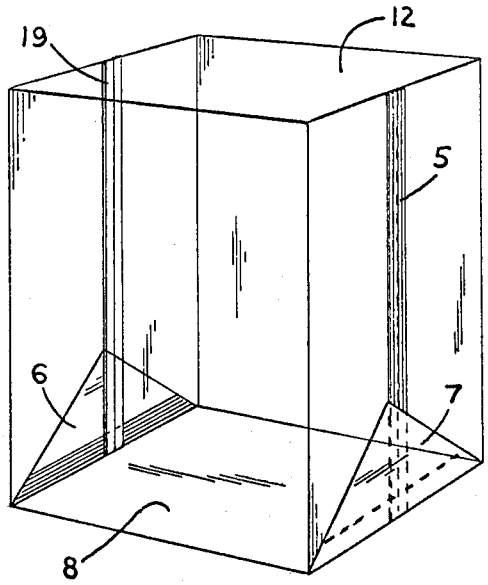
FIG. 3
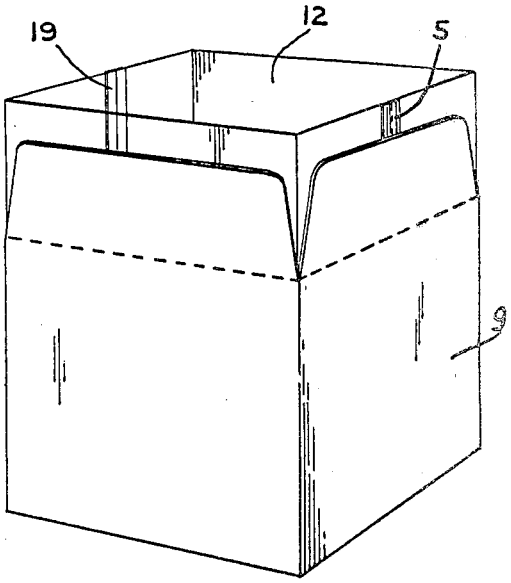
FIG. 4
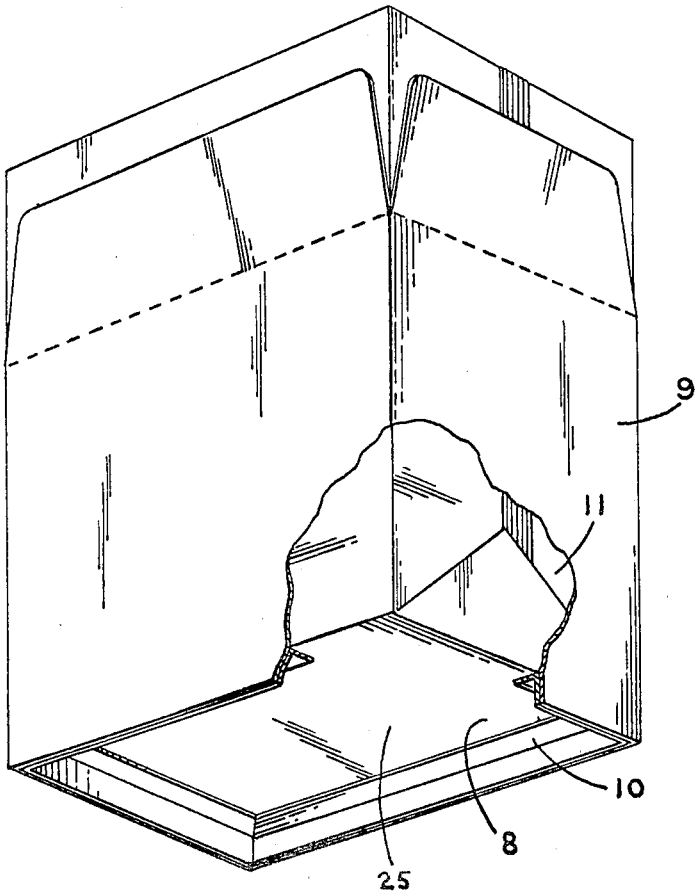

PROCESS OF PRODUCING A PACKAGE OR WRAPPING FOR STORING OR SHIPPING MATERIAL

The present application is a divisional application based on application Ser. No. 681,231 filed Apr. 28, 1976 and now abandoned.

The specification of the present invention relates to a package of the type consisting of an outer supporting covering and a container of pliable material placed therein and intended for liquid, semi-liquid, powdered, semi-solid and solid goods.

BACKGROUND

In U.S. Pat. No. 3,944,127 issued Mar. 16, 1976 packages having a construction in accordance with the above-indicated principle are described. The aforementioned patent discloses a package which is intended for containing goods of one of the above-mentioned types under constant of increasing conditions of pressure.

Previously known packages having an inner flexible container within an outer supporting covering have their containers arranged more or less loosely in the outer containers, so that the emptying of the packages is made difficult. In cases in which the inner container was attached to the outer covering, this attachment was not provided in order to facilitate the emptying of the package. The packages described in the aforementioned patent have, in contradistinction to this, their flexible inner container and outer supporting covering, so developed and secured to each other that the emptying of the packages is facilitated. The concept of facilitated emptying includes, also, the possibility of emptying the stored goods gradually from the package and closing the package again in a simple and effective manner after each removal of the goods.

The reclosing of the packages described in the above-mentioned patent is made possible by the fact that the outer supporting covering of the package is firmly connected to the inner flexible container around the mouth of the opening. A lid of, for instance, plastic, which rests tightly against the opening of the outer container, as a result of this design, also closes the inner container.

It is furthermore a characteristic feature of packages in accordance with the above-mentioned patent that the inner containers are filled before they are placed into the outer supporting coverings. In certain cases, it is inadvisable to make use of this method. This may be the case, for instance when the packages are to be used for storing materials which do not retain their shape, for instance liquids, or when the manufacturer of the material which is to be stored in the packages wishes to utilize for the filling thereof the equipment which he already has and which is designed for filling containers which are already entirely complete.

SUMMARY OF THE INVENTION

The present invention refers to a method of making a package which, when filled, has the same properties as the packages described in the patent and the properties of which, upon emptying, are the same as the properties of containers manufactured in accordance with the aforementioned applications, the package, however, only being filled after the inner container has been combined with the outer supporting covering.

The package may be of rectangular or parallelepiped shape and the one wall side may represent the access wall of the package. In this case, the inner container is fastened to the periphery of this wall in such a manner that one of the sides of the inner container forms a lid at the accessible wall and can easily be cut with a knife. In this connection, it is desirable for this side of the inner container to have a flat surface without joints, folds, or flaps. The opening of the package is combined with a lid of plastic, for instance, which after the package has been opened seals it tightly. The shape of the access opening may vary. It may, for instance, have completely flat walls or it may be provided with an inwardly directed circumferential flange. In the latter case, it may frequently be advisable to fasten the inner container to such flange. In this way, opening the container is facilitated, particularly when this is effected by cutting the lid disk out with a knife.

It is also characteristic of the invention that the package has such an arrangement that the filling thereof is effected through a part of the package which subsequently represents the bottom of the completed, filled package. In order that the inner container has, within the assembled, closed package, a flat surface in the direction which is subsequently to correspond to the opening portion of the filled package, the inner container is folded together in a special manner. The folding will be explained in detail with reference to the drawings, which form an integral part of the present application. The inner container, after having been folded together, is inserted into the outer supporting cover and fastened to it at the part which corresponds to the access portion of the package upon the opening thereof. During the filling, this part represents the bottom of the package. When the inner container has been inserted into the outer supporting cover and fastened therein, the inner container has the shape of an open parallelepiped or rectangular preferably of a flat bottom, with two of its sides provided with a welded joint and flaps extending up from the preferably flat surface on each of the sides provided with joints.

Upon the filling, the package, therefore, consists of an inner container which is surrounded by an outer supporting covering and is fastened to the latter in that part of the package which serves as bottom of the package during the filling. The package is then closed in normal manner by means of a suitable method of folding, employing for instance welding or glueing.

One advantage of making the package is that a relatively cheap material can be used for the outer supporting covering, while a flexible material which is selected with reference to the physical properties required by the goods to be stored is used for the inner container. The use of relatively expensive material is thus limited merely to the inner container.

Another advantage of the making of the package is that the inner container and the outer supporting covering are fastened to each other so that when the package has been emptied the inner container can be easily separated from the outer covering. This facilitates recovery of the material as the different used types of material can be easily separated from each other.

The method according to the invention will be described in detail with reference to the Figures shown in the drawing, in which:

BRIEF DESCRIPTION OF THE DRAWING FIGURES

FIG. 3 shows an inner container which has been prepared for insertion into an outer supporting covering;

FIG. 4 shows a complete package with the inner container and the outer supporting covering, ready to be filled;

FIG. 5 shows a complete package seen from the bottom—referred to the filling opening—and with the outer covering partially cut away in order to show how the inner container is arranged in the outer covering;

DETAILED DESCRIPTION OF THE DRAWING FIGURES

Figure 1:
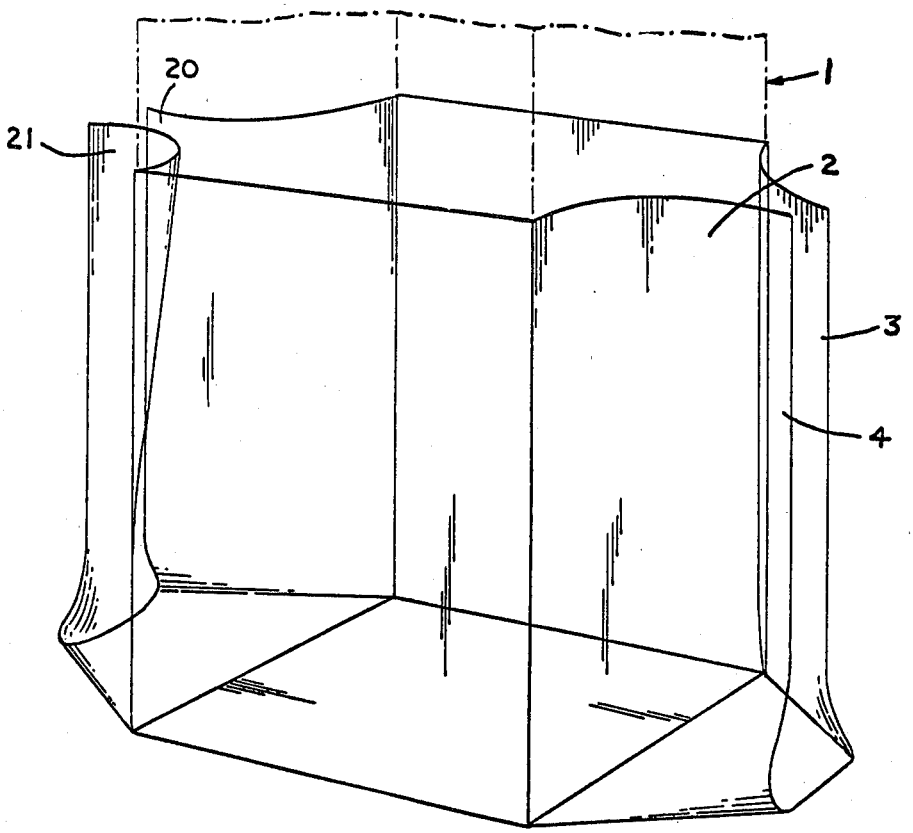
FIGS. 1 and 2 show various method steps during the folding of the inner container.

In FIG. 1, is shown flexible sheet material 2, which is to be folded together to form an inner container. A mandrel 1 is partially surrounded by the flexible material. The flexible material 2 can be transparent, in which case the content such as coffee in the mandrel in the Figure is not concealed by the flexible material. The dimensions and shape of the mandrel correspond to that of the inner packing which is being produced. The edge portions of the flexible sheet material which is to be shaped to form the inner container are designated 3 and 4 and 20 and 21 respectively.

Figure 2:
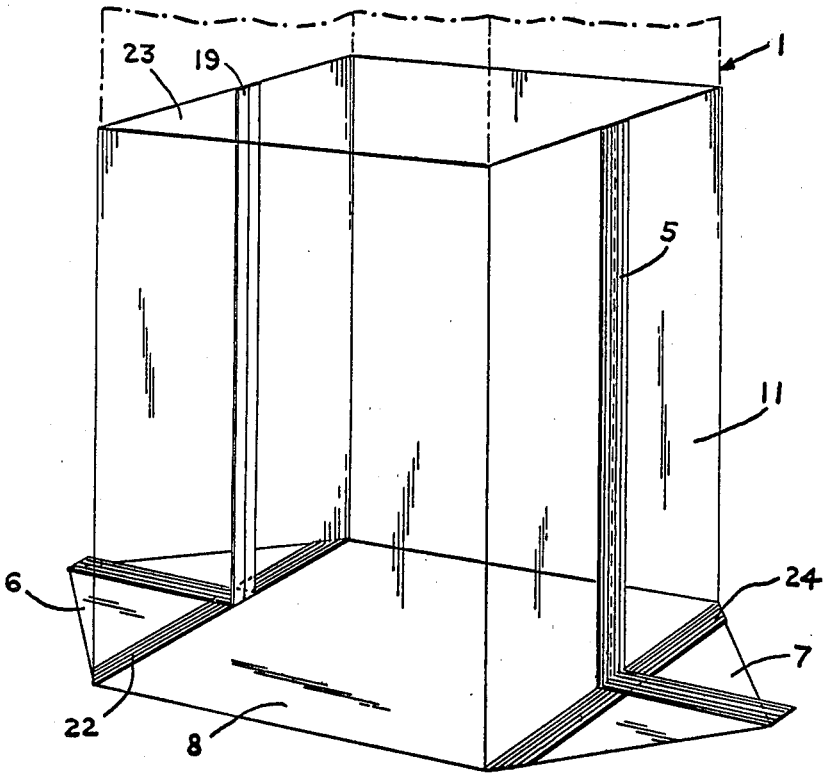

In FIGS. 2 and 3, the reference numerals 5 and 19 represent longitudinal adhesive seams which join the edge portions 3 and 4 and 20 and 21 respectively together. The side wall which contains the longitudinal adhesive seam 5 is marked 11 and the side wall which contains the longitudinal adhesive seam 19 is marked 23. In the transition between the side walls having the adhesive seams and the bottom part 8 of the inner container the two adhesive seams 22 and 24 connect the bottom wall with the two flaps 6 and 7. In FIG. 3 flaps 6 and 7 are folded upwardly against the corresponding side. The inner container in this Figure has the shape which corresponds to the shape of the container when it is inserted into its outer supporting covering and is ready for filling with the goods.

In FIGS. 4 and 5 the inner container has been inserted and fastened in the outer packing. In FIG. 4, the assembled package is shown obliquely from above, while in FIG. 5 it is shown obliquely from below. In FIG. 5, the outer packing has furthermore been partially cut away. In the Figures there is also shown the outer supporting covering or outer packing 9 with the inwardly directed circumferential flange 10. The inner container is fastened to the inwardly directed circumferential flange of the outer packing adjoining the outer edges of the bottom surface 8. In the package formed in this manner the smooth bottom surface forms a flat disk 25 as shown in FIG. 5. The filling opening 12 of the inner container is also shown.

Figure 6:
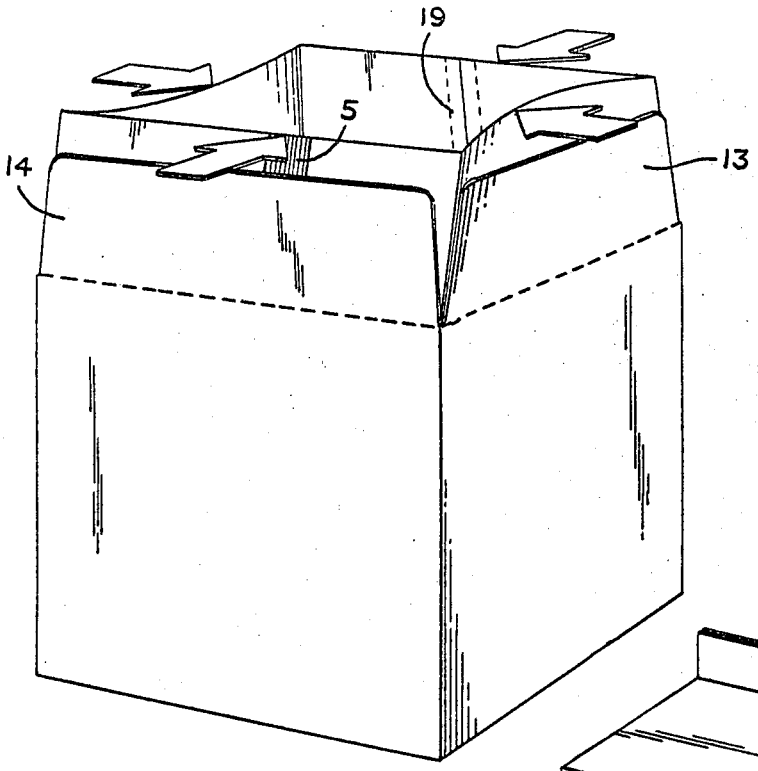
FIGS. 6 to 8 show an alternative method for the enclosing of the inner container in the filling part thereof.
Figure 7:
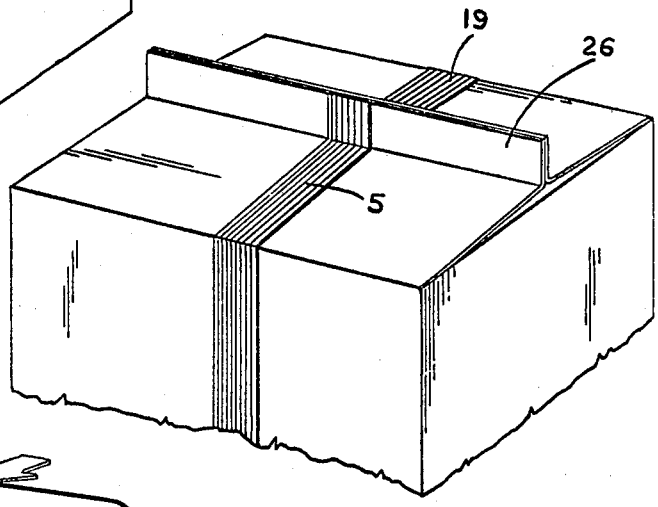
Figure 8:
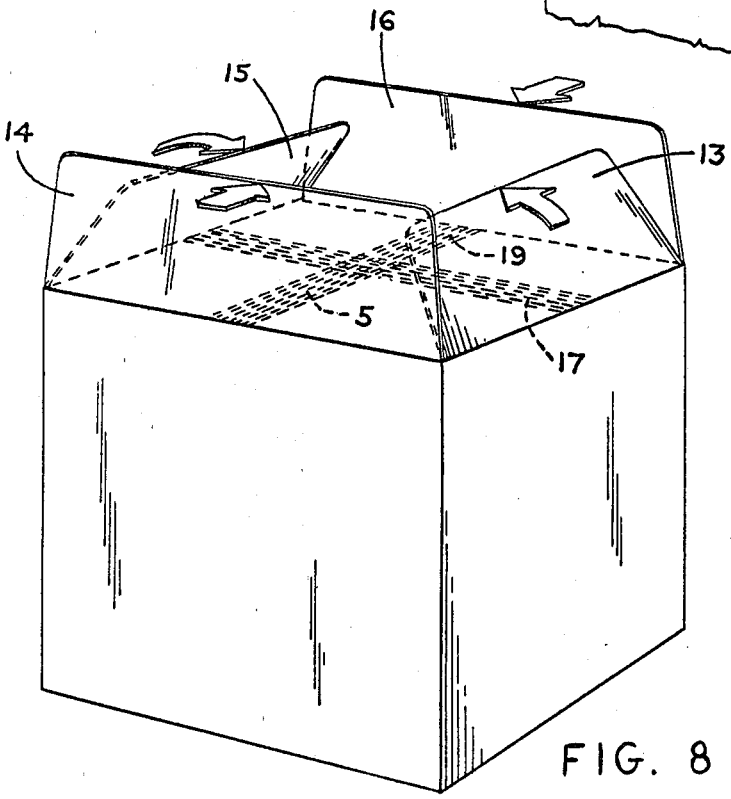
Figure 9:
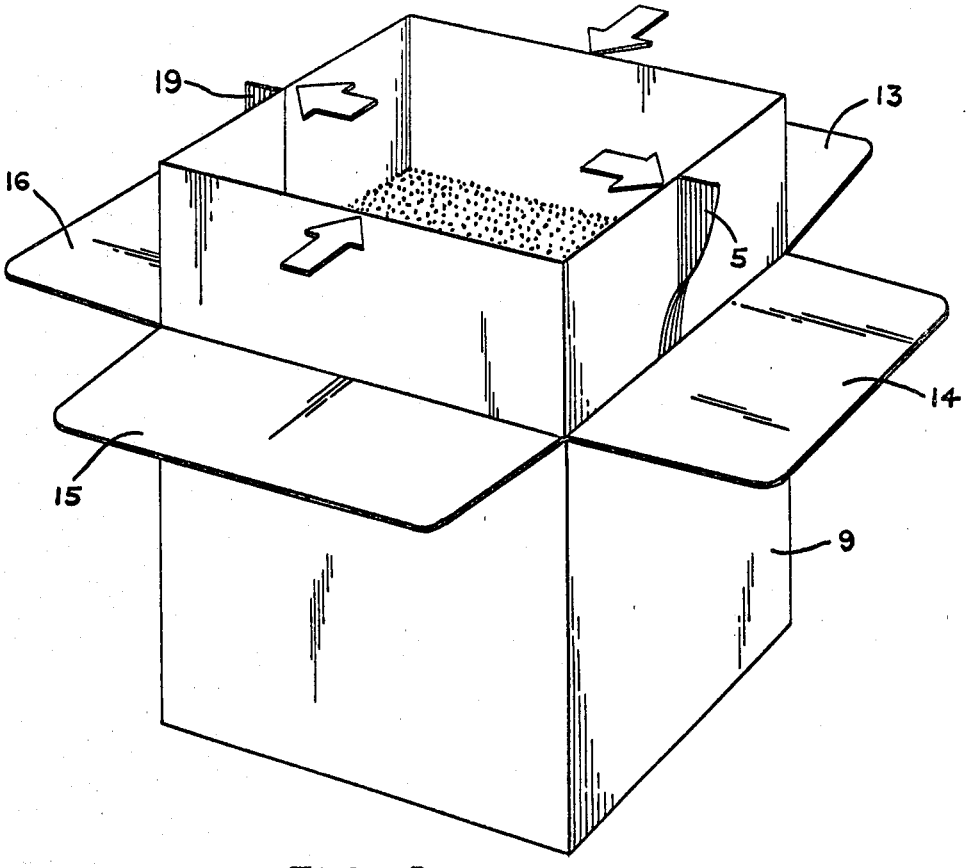
FIGS. 9 to 11 show another alternative method for the closing of the inner container.
Figure 10:
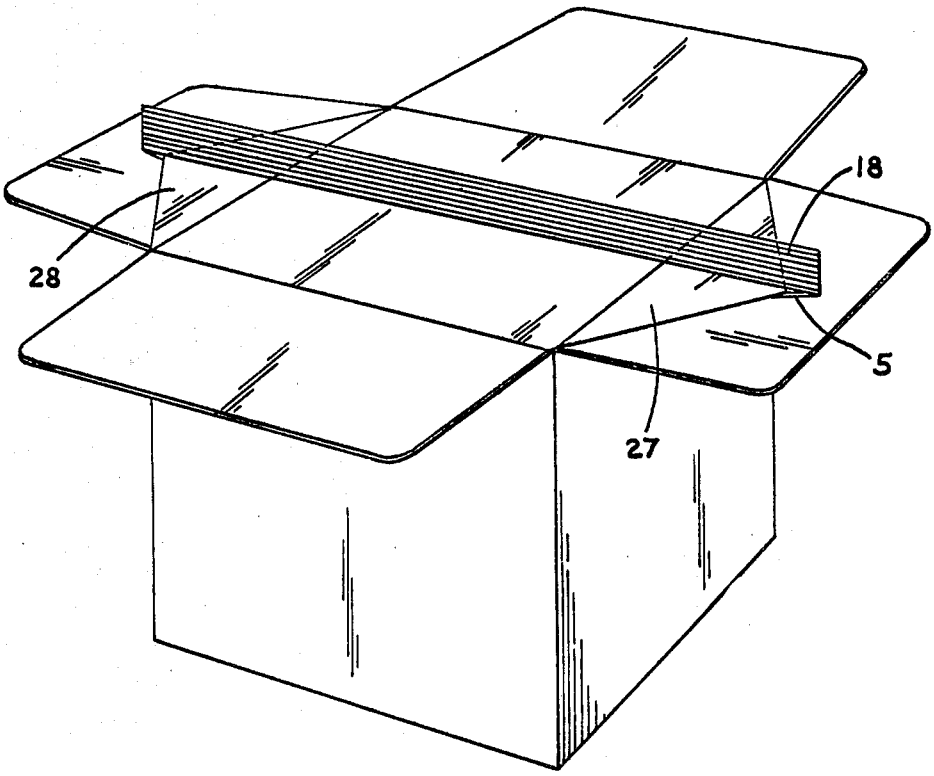
Figure 11:
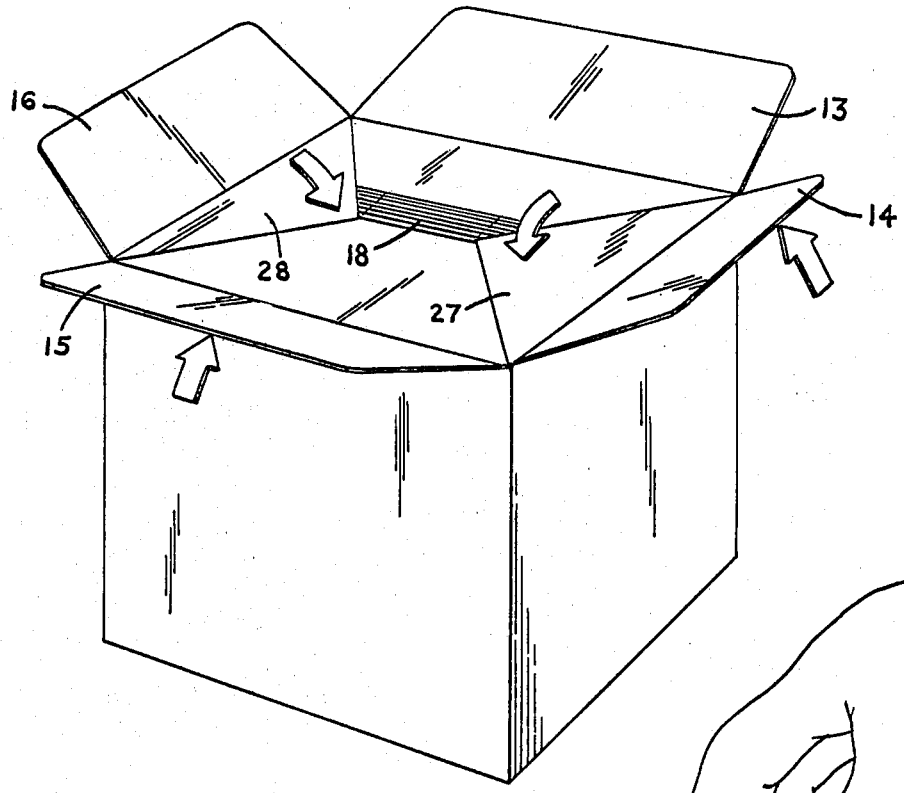

FIGS. 6 to 11 show two different alternative methods of folding, for closing the inner container after the filling. FIGS. 6 to 8 show one alternative, while FIGS. 9 to 11 show the other. In accordance with both alternate methods of folding, the closing of the inner container is effected by means of an adhesive. In the first alternate method of folding, the adhesive is designated 17, while in the other alternative it is designated 18. The closure flaps of the outer packing are marked with reference numerals 13, 14, 15 and 16.

FIG. 7 shows a detailed view of the folded opening-part of the inner container in accordance with the first method of folding. The folded opening part forms a flange-like upwardly directed edge 26, which is ready for fastening by adhesive. The flaps 27 and 28 formed upon folding are shown in FIGS. 10 and 11.

Figure 12:
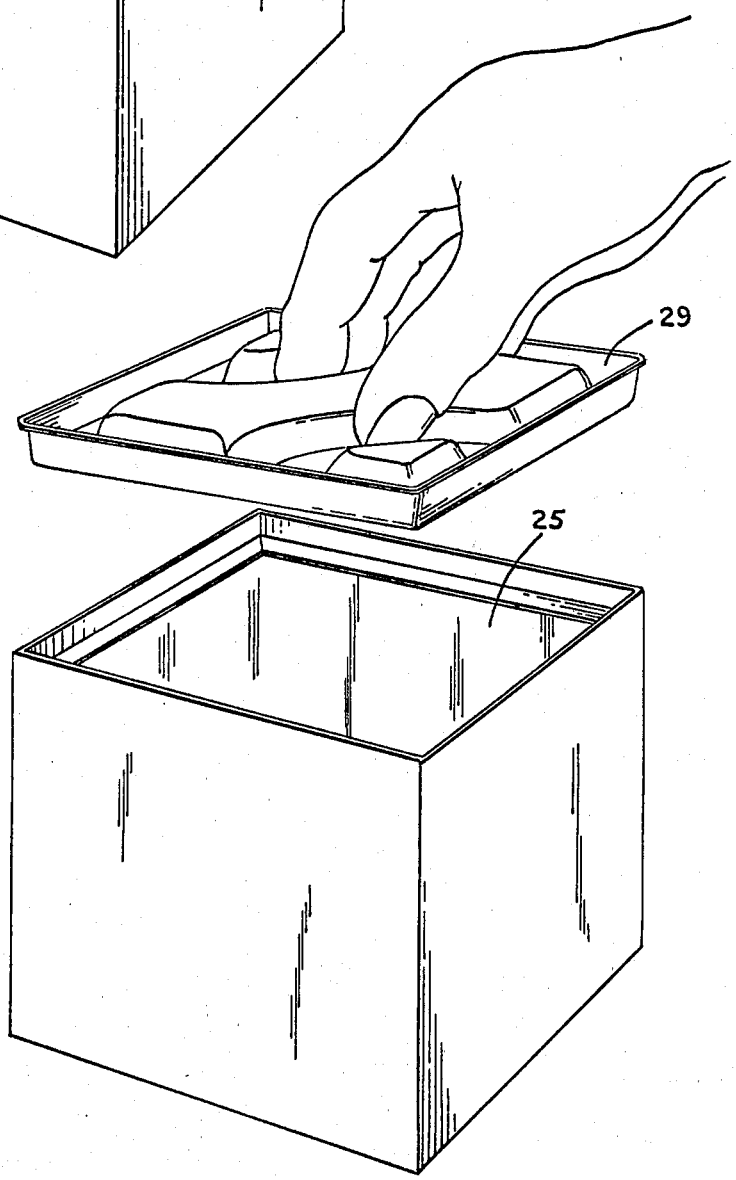
FIG. 12 shows a filled package while its lid is being removed from it.

FIG. 12 shows a filled package and a reclosure lid 29. The lid of the package is shown during its removal.

The construction of the inner container, i.e. the manner in which it is folded together, may be easier understood by visualizing folding together of an inner container. In this connection one proceeds from a sheet of flexible material 2, upon which a mandrel 1 is placed. The outer shape of the mandrel has then the shape of the inner container which is to be produced. Furthermore, the dimensions of the sheet are in accord with the size of the container to be produced. Parts of the sheet are then pulled upwardly on two sides of the mandrel which are opposite to each other and vertical in the manner shown in FIG. 1.

In this manner a U-like bag is formed from the sheet, the bag being open at the top and on both sides, said sides corresponding to the two other opposite sides of the mandrel. The vertical parts of the sheet which protrude above the mandrel are bent over towards each other so that the edge parts 3 and 4 and also parts 20 and 21 meet in such a manner that strips on each side of the edge parts togeher form a flange which protrudes at right angles from the surface of the mandrel and in such a manner that the remaining part of the inner surface of the sheet rests against side surfaces corresponding to those on the mandrel. Due to the fact that a flat positioning is obtained for all the vertical portions of the inner container, a fold is provided on each side along the transition between the vertical wall and the bottom wall of the mandrel while flaps 7 and 6 are formed which protrude from said folds. The edge parts 3 and 4 and also 20 and 21 are now adhered to each other and the corner adhesives 22 and 24 are now effected in the fold, i.e. the fold which lies in the transition between the vertical walls of the mandrel and the bottom wall in order to stabilize the folds and thus the shape of the container. The two flaps are then turned up on either side and the inner container has the appearance shown in FIG. 3.

An inner container such as shown in FIG. 3 accordingly has a smooth bottom wall 8 which has neither folds nor adhesives, two vertical sides which are also entirely smooth and two vertical sides on which are the longitudinal adhesives 5 and 19 and flaps 7 and 6 which have been bent against the sides. The sixth side of the container constitutes its filling opening 12.

In accordance with the invention, the inner container arranged in this manner is inserted into an outer supporting covering 9, in the manner shown in FIGS. 4 and 5. The smooth bottom wall of the inner container is fastened at its edges to the inwardly directed circumferential flange 10 in the outer supporting covering. The smooth bottom wall in this connection forms the flat lid 25. A composite package constructed in this manner has a filling opening for the inner container which does not differ as to its filling from known filling openings of packages. After the filling, the inner package is closed by folding the opening part and then adhering. FIGS. 6 to 8 show examples of a method of folding which can be used in this composition and FIGS. 9 to 11 show an alternative method of folding.

In the first method of folding, two of the sides of the opening of the inner container are first moved inwardly, whereupon the other two sides are also bent against each other, in the manner shown in FIG. 6. The inwardly-folded sides are preferably the sides which do not have a vertical adhesion seam. It is assumed that the inner container is filled with material of relative fixed shape. By adjusting the required folding device (conventional) in suitable manner, the folded filling part of the inner container forms a flat wall parallel to the plane of the lid. From this wall extends a flange-like strip 26, in the manner shown in FIG. 7. The closing of the inner package is then effected by, for instance, coating the strip with adhesive. After the flange has been attached, it is bent over against the flat wall which has been formed above the material in the package. The inner package has now the appearance shown in FIG. 8. The flaps 13, 16 of the outer container can now be folded over each other, for instance in the manner shown in FIG. 8, and are thereupon fastened to each other. This part of producing the package is thus complete.

With the other folding method, which is preferable in the case of vacuum packing, two of the sides of the opening part of the inner container are pulled aprt in the manner shown in FIG. 9. As a result, the opening part of the inner container will assume the appearance shown, by way of example, in FIG. 10. The opening part of the inner container is glued on thereby obtaining the seal designated 18 in FIG.10. The flaps 27 and 28 are bent over—see FIG. 11—whereupon the flaps 13, 16 of the outer container are folded over each other and fastened to each other thereby completing this part of the container.

As it is now apparent, glueing of the inner container by the alternative last described simplifies some of the problems inherent in obtaining a tight seal. In the previously known packings the folding together is effected in such a manner that a varying number of overlapping layers of wall material is obtained in the region of the joint. For instance, when connection by glueing is made the glueing devices are thereby compelled to absorb large differences in thickness in the region of the seal. This is made possible by the fact that the jaws yield somewhat, due to ample use of glued material, so that said material flows out everywhere, and/or by profiling the region of the adhesive.

When glueing in accordance with the second alternative of the invention, all such variations of thickness in the region of the glue are avoided, as there are no folds or double-folds of the layers of the sheet material to be connected. Hence the demands made on the equipment which is to effect the joining are reduced and, at the same time, the possibilities of obtaining a tight connection are increased.

The opening part of the assembled package which has been closed for instance by one of the alternatives described above, thereupon forms the bottom part of the filled package. The opening part for the filled package consists of the smooth lid described above, together with the surrounding parts of the supporting covering. The package will be used normally in the position shown in FIG. 12. A lid 29 is placed on the opening part thereby protecting it from damage. The lid is held in its seat by a friction fit in the opening of the outer cover and by the fact that, for instance, a sealing strip is fastened over it.

Upon the opening of the package, the sealing strip is torn open, the lid is removed, and the flat lid is cut out. If the package is only partially emptied, it can be closed again by means of the lid 29. In this way the package has properties similar to a can. However it is substantially cheaper to manufacture than previously known containers of the can type.

As suitable material for the inner container and the outer covering, there may be used paper board, cardboard, synthetic plastics material, metal, or the like, and also combinations of such materials. If the material is used for the inner container it must however be flexible, while if used for the outer supporting cover it should be stiff.

The packings described in Swedish Patent Applications Nos. 73 126 83-1 and 73 126 84-9 refer to packings which are developed in a manner corresponding to the development of the packing in accordance with the present description. The inner container of the packings in accordance with said applications are, to be sure, filled with their material before they are placed in the outer supporting covers. Upon filling they have a tubular shape and are then so closed by means of suitable members that the filled inner container has the same geometrical shape as the outer cover. The packing described in the present specification is filled after its inner container has been fastened in the outer cover. Due to the different methods of filling the packings, the packing described in the present application requires a folding together and thus a construction which differs fundamentally from the heretofore known method of folding, and thus the construction of the aforementioned packings.

In the new packing described here, two of the edge flaps 6 and 7 are folded against two of the side surfaces of the inner packing. This results in a stiffening effect for both, the inner packing and the combined packing. In particular the stiffening of the inner packing facilitates the handling of the package when empty. In certain uses, due to the stiffening, a thinner cardboard can be used.

One advantage of the container of the invention is that the re-closure lid 29 does not extend out from the outer walls of the package. As a result, the space available on pallets and in containers is optimally utilized.

If foil is used for the inner container, the smooth lid 29 in the opening part of the package affords the possibility of seeing the content of the package. This may constitute useful information for the consumer when considering the purchase of a given article.

The smooth lid in the opening part of the container can be provided with designs and data, giving information, for instance, as to the composition of the goods, how to open the package, etc. or serving merely for decorative purposes. It can also be provided with perforations or other intended tear points, which facilitate the removal of the lid 29.

In the above description it has been stated that the inner container is to have a smooth, joint-free surface on the side walls which the inner containers presents towards the opening part of the composite package. It is obvious that the inventive concept—namely the combining of an outer supporting cover with a flexible container arranged therein and which is filled after the inner container has been fastened in the outer cover—may also comprise other foldings of the inner container. As a result of such other foldings, it may be that the opening part of the inner container no longer has a smooth joint-free surface. Such a folding of the inner container, however, means that the opening part is normally less attractive in appearance and at the same time it is made somewhat difficult to cut open the inner container.

In certain cases of use, it is desirable to facilitate the removal of the lid after it has been cut out from the inner container. This can be done by fastening a special grip device to said lid. Such a grip device may also be combined with a perforation on the lid Such perforation facilitates the cutting-open of the lid or represents a part of an easy-opening device for the lid. In certain embodiments, the alternative methods of folding mentioned in the preceding paragraph can be developed in such a manner with a joint in the lid. Such joint can be used as gripping device for the removal of the lid when it has been cut out.

In the above description, it has been assumed that the inner container is made of a separate sheet of foil which has been cut to the dimensions of the inner container. It is obvious that this sheet can also be cut to shape during the initial part of the folding of the container. In this case, the material for the inner container is accordingly removed for instance from a roll of foil material. It is also possible for the inner container to consist of a plurality of sheets or blanks.

It has furthermore been assumed in the description that the folding of the inner container is fixed by adhesive means.

The invention has been described as a combination of an inner container and an outer supporting cover. It is obvious that inner containers which have been folded to shape and secured in such shape as described above, can be used without being combined with an outer supporting cover if the containers have been made of flexible material and also when they have been made of a stiffer material.

What is claimed, is:

1. A method of forming a package filled with material comprising folding a continuous flat sheet of flexible material onto a mandrel to form an inner container having four side walls, an open top, and a closed bottom wall which define a parallelepiped shape, the material having overlapping edges extending along each of two of said four side walls opposite to one another, joining the overlapping edges along the entire longitudinal length of each of the side walls to form a longitudinal seam therealong with a flap extending from said bottom wall, each of the longitudinal seams extending continuously from the side wall along the respective flap, forming a transverse seam at each said flap at the juncture thereof with the respective side wall, folding said flaps around the transverse seams and into sealed engagement against the respective side walls, said bottom wall being constituted by the thickness of the sheet of material of the inner container and being free from flaps and folds to form a flat smooth surface, forming an outer container of stiffer material than the inner container with four side walls corresponding to said four side walls of said inner container and opposite open ends, and a circumferential flange positioned adjacent to and spaced from one end of the outer container, said circumferential flange extending inwardly from the inner surfaces of said four side walls of said outer container, inserting the inner container into the outer container through the other of the open ends so that the bottom wall of the inner container rests on said circumferential flange, securing the bottom wall of the inner container to the circumferential flange, the transverse seams at said flaps of the inner container stabilizing the folds between the flaps and the side walls of the inner container and also stabilizing the shape of the inner container in the region where the bottom wall is secured to the circumferential flange of the outer container, filling the inner container with the material to be stored therein, closing and sealing the open top of the inner container and the outer container at said other of the open ends, inverting the containers so that the bottom wall of the inner container faces upwardly and constitutes the end at which the material can be removed from the inner container by opening said bottom wall, and sealably and removably fitting a cover lid within the outer container to rest on the circumferential flange such that by removing said cover lid and cutting open said bottom wal of said inner container at the opening defined by said circumferential flange the filling material in said inner container may be discharged.

2. A method as claimed in claim 1 wherein said seams at the juncture between the flaps and side walls extend along the entire width of the side walls.

3. A method as claimed in claim 1 wherein said circumferential flange is recessed from said one end wall of the outer container such that upon filling of the inner container with the material the entire weight of the inner container and material will bear on the circumferential flange.

4. A method as claimed in claim 1 wherein the open top of the inner container is closed and sealed by pushing the opposite side walls lacking the longitudinal seams inwardly so that these side walls are folded and form a flat closure in a plane at the top of the inner container, pushing the opposite side walls with the longitudinal seams towards one another while folding these walls onto the flat closure, upwardly bending free edge portions of the latter walls, bringing said free edge portions into contact with one another, sealing the contacting free edge portions to form an upstanding strip-like flange, folding the flange into the plane of the flat closure, and sealing the flange against the folded side walls in the plane of the flat closure.

5. A method as claimed in claim 1 wherein the open top of the inner container is closed and sealed by folding the opposite side walls inwardly to form a flat layer and sealing said layer to form a sealed closure at the top of the inner container.

6. A method as claimed in claim 3 wherein said overlapping edges of said inner container are joined by applying strips of adhesive material on the facing surfaces of the two overlapping edges along the length thereof, folding the opposite side walls lacking the longitudinal seams inwardly so as to form a flat top wall for the inner container; an end portion of each of said folded-over portions extending upwardly from said top wall in engagement with each other, said strips of adhesive material joining said upwardly extending end portions whereby the inner container filled with material is closed and sealed.

7. A method as claimed in claim 1 wherein said longitudinal and transverse seams are formed by welding.

8. A method as claimed in claim 1, wherein the open top of the inner container is closed and sealed by pushing inwardly two opposite side walls of said inner container while simultaneously pulling the other two opposite side walls outwardly to form mating edges and outwardly extending flaps, sealing the mating edges and folding and the flaps against said sealed mating edges.

* * * * *